US007791007B2

(12) United States Patent
Harnoy

(10) Patent No.: US 7,791,007 B2
(45) Date of Patent: Sep. 7, 2010

(54) TECHNIQUES FOR PROVIDING SURFACE CONTROL TO A GUIDABLE PROJECTILE

(75) Inventor: Amir Harnoy, Woodland Hills, CA (US)

(73) Assignee: Woodward HRT, Inc., Santa Clarita, CA (US)

( * ) Notice: Subject to any disclaimer, the term of this patent is extended or adjusted under 35 U.S.C. 154(b) by 415 days.

(21) Appl. No.: 11/820,815

(22) Filed: Jun. 21, 2007

(65) Prior Publication Data

US 2008/0315032 A1 Dec. 25, 2008

(51) Int. Cl.
*F42B 10/00* (2006.01)
*F42B 10/52* (2006.01)
*F42B 10/62* (2006.01)

(52) U.S. Cl. ..... 244/3.21; 244/3.24; 244/3.23

(58) Field of Classification Search ..... 244/3.23, 244/3.29, 3.21, 3.1, 3.24; 102/384; 114/23
See application file for complete search history.

(56) References Cited

U.S. PATENT DOCUMENTS 3,167,275 A 1/1965 Hermann et al.
3,611,943 A 10/1971 Popper et al.
3,747,529 A 7/1973 Plattner
3,826,193 A 7/1974 Rognmo et al.
3,994,228 A 11/1976 Hurlimann
4,004,519 A 1/1977 Hopkins
4,088,076 A 5/1978 Karayannis
4,142,696 A 3/1979 Nottingham
4,248,153 A 2/1981 Sjotun et al.
4,577,116 A 3/1986 Pinson
4,665,332 A 5/1987 Meir
4,898,342 A 2/1990 Kranz et al.
4,925,130 A * 5/1990 Kranz ..... 244/3.21
4,964,593 A 10/1990 Kranz
5,115,742 A 5/1992 Frazer
5,139,216 A * 8/1992 Larkin ..... 244/3.21
5,452,864 A 9/1995 Alford et al.
5,467,940 A * 11/1995 Steuer ..... 244/3.11
5,975,461 A * 11/1999 Ullrich ..... 244/3.21
6,364,248 B1 * 4/2002 Spate et al. ..... 244/3.23
6,708,923 B2 * 3/2004 Kusic ..... 244/34 R
6,845,714 B1 1/2005 Smith et al.
7,095,193 B2 8/2006 Kellogg et al.
7,109,679 B2 9/2006 Edson et al.
7,116,100 B1 10/2006 Mock et al.
2002/0139896 A1 * 10/2002 Pellegri et al. ..... 244/3.24

(Continued)

FOREIGN PATENT DOCUMENTS

DE 102005043474 A1 3/2007

(Continued)

*Primary Examiner*—Tien Dinh
(74) *Attorney, Agent, or Firm*—BainwoodHuang

(57) ABSTRACT

A guidable projectile has a central shaft, a projectile body, and a surface control assembly. The projectile body is arranged to rotate around at least a portion of the central shaft during flight of the guidable projectile to provide stabilization. The surface control assembly is supported by the central shaft. The surface control assembly includes a movable member arranged to control a trajectory of the guidable projectile during flight of the guidable projectile, and an electromagnetic actuator interconnected between the central shaft and the movable member. The electromagnetic actuator is arranged to control movement of the movable member relative to the central shaft.

20 Claims, 10 Drawing Sheets

U.S. PATENT DOCUMENTS

| | | | | |
|---|---|---|---|---|
| 2005/0150999 | A1* | 7/2005 | Ericson et al. | 244/3.24 |
| 2006/0065775 | A1 | 3/2006 | Smith et al. | |
| 2008/0142591 | A1 | 6/2008 | Jenkins et al. | |
| 2008/0302906 | A1 | 12/2008 | Bar et al. | |

FOREIGN PATENT DOCUMENTS

| | | | |
|---|---|---|---|
| EP | 0675335 | A2 | 10/1995 |
| EP | 1635135 | A1 | 3/2006 |
| EP | 1930686 | A1 | 6/2008 |
| GB | 1605392 | A | 4/1995 |
| WO | 8203453 | A1 | 10/1982 |
| WO | 2007030687 | A2 | 3/2007 |
| WO | 2008108869 | A2 | 9/2008 |

* cited by examiner

TECHNIQUES FOR PROVIDING SURFACE CONTROL TO A GUIDABLE PROJECTILE

BACKGROUND

A typical conventional guided projectile includes a nose cone and a main casing (e.g., an artillery shell casing). The nose cone is capable of moving relative to the main casing and is thus capable of changing the direction of the projectile's trajectory while the projectile is in flight.

To effectuate movement of the nose cone relative to the main casing, the conventional guided projectile further includes a nose cone actuator having an actuator mount and a movable (or actuated) part which moves relative to the actuator mount. The actuator mount of the actuator connects to the main casing and the movable part of the actuator connects to the nose cone to enable pointing or articulating the nose cone relative to the main casing.

In some conventional guided projectile designs, the main casing and the nose cone are required to rotate relative to each other. For such designs, the entire nose cone actuator (i.e., the actuator mount and the movable part) rotates relative to the main casing so that the nose cone actuator can continue to point the nose cone in a particular targeted direction. That is, while the main casing rotates around both the actuator mount and the movable part of the nose cone actuator during flight, the actuator extends or retracts the movable part to properly articulate the nose cone at a particular angle relative to a center axis of the main casing thus controlling the direction of the guided projectile.

SUMMARY

Unfortunately, there are deficiencies to certain conventional guided artillery shell designs due to demands placed on various components of these designs. In particular, if the control circuitry and the power source for the nose cone actuator reside at fixed locations within the main casing, specialized connecting devices are required to transmit electrical power and electrical control signals from the control circuitry and the power source within the main casing to the nose cone actuator while the main casing rotates relative to the nose cone actuator.

An example of such a specialized connecting device is a slip ring, i.e., a rotary electrical joint. Unfortunately, slip rings provide potential points of failure particularly in view of various extreme environmental conditions that may exist within the guided projectile (e.g., high G-forces, high temperatures, etc.). That is, it is extremely difficult for slip rings to survive the high acceleration of the guided projectile during launch, and then to withstand extremely high operating temperatures while the guided projectile is in flight. Without reliable performance, the guided projectile may inadvertently damage or destroy an unintended target. Furthermore, slip rings are costly and may impact the affordability of the weapon system's controller.

In contrast to the above-described conventional guided projectile designs which place the control circuitry and the power source for a nose cone actuator at fixed locations within the main casing, improved techniques involve utilization of a stator (of a brushless electric motor) which attaches to a nose member (e.g., a nose cone of a guidable projectile) and a rotor (of a brushless electric motor) which attaches to a projectile body (e.g., a main casing of the guidable projectile). Accordingly, the stator and the rotor form a motor/generator which is capable of (i) controlling rotation of the projectile body relative to the nose member as well as (ii) generating power. Moreover, electrical control of the stator and other electrical or electromechanical components (e.g., a nose cone actuator) are capable of residing at fixed locations relative to the stator (e.g., on the stator spindle) thus alleviating any need to convey electrical power and electrical control signals from the projectile body to the stator or to the nose member through slip rings.

One embodiment is directed to a guidable projectile having a nose member, a projectile body, and a nose member articulation assembly which couples the nose member to the projectile body. The nose member articulation assembly includes a stator attached to the nose member, a rotor attached to the projectile body, and rotational support hardware interconnecting the stator to the rotor. The stator defines a central axis. The rotational support hardware is constructed and arranged to guide rotation of the rotor around the central axis defined by the stator. Such a guidable projectile enables circuitry such as the driver of the stator and the power source to reside at fixed locations relative to the stator thus alleviating the need for slip rings which would otherwise present potential points of failure.

Another embodiment is directed to a guidable projectile which includes a central shaft, a projectile body, and a surface control assembly. The projectile body is arranged to rotate around at least a portion of the central shaft during flight of the guidable projectile to provide stabilization. The surface control assembly is supported by the central shaft. The surface control assembly includes a movable member arranged to control a trajectory of the guidable projectile during flight of the guidable projectile, and an electromagnetic actuator interconnected between the central shaft and the movable member. The electromagnetic actuator is arranged to control movement of the movable member relative to the central shaft.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Improved nose articulation techniques involve utilization of (i) a stator which attaches to a nose member (e.g., a nose cone of a guidable projectile) and (ii) a rotor which attaches to a projectile body (e.g., a main casing of the guidable projectile). Accordingly, the stator and the rotor form a motor/generator which is capable of (i) controlling rotation of the projectile body relative to the nose member as well as (ii) generating electrical power. Moreover, electrical control of the stator and other electrical or electromechanical components (e.g., a nose cone actuator) are capable of residing at fixed locations relative to the stator (e.g., on the stator spindle) thus alleviating any need to convey electrical power and electrical control signals from the projectile body to the stator or to the nose member through slip rings.

Figure 1:
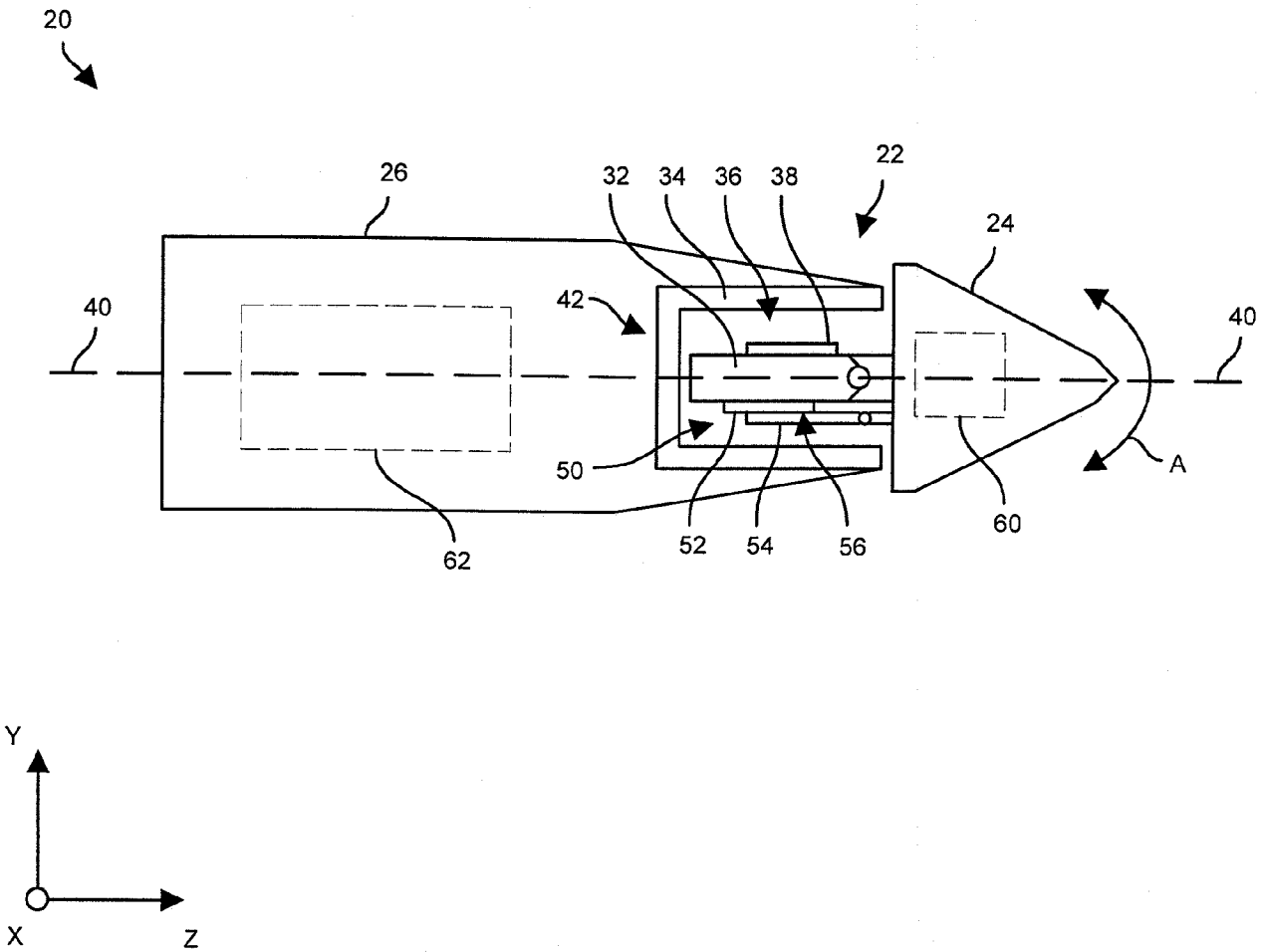
FIG. 1 is a general view of a guidable projectile having a nose member articulation assembly which includes a stator which attaches to a nose member and a rotor which attaches to a projectile body.

FIG. 1 is a general view of a guidable projectile 20 having an enhanced nose member articulation assembly 22. The guidable projectile 20 further includes a nose member 24 and a projectile (or munition) body 26. The nose member articulation assembly 22 operatively interconnects the nose member 24 and the projectile body 26 together.

As shown in FIG. 1, the nose member articulation assembly 22 includes a stator 32 (e.g., motor winding assembly over a magnetic iron core), a rotor 34 (e.g., a rotatable member with magnet poles and magnetic back iron), rotational support hardware 36 (shown generally by the arrow 36 in FIG. 1), and control circuitry 38. The stator 32 pivotally attaches to the nose member 24. The rotor 34 rigidly attaches to the projectile body 26. The rotational support hardware 36 (shown in further detail in later figures) interconnects the stator 32 to the rotor 34 in a rotatable manner which enables the rotor 34 to rotate relative to the stator 34 around the central axis 40. The control circuitry 38 mounts to a fixed location on the stator 32.

As will be explained in further detail shortly, the rotational support hardware 36 includes bearings and specialized components and geometries which cooperatively unload extreme G-force stresses (e.g., high-G shock pulses encountered during a cannon launch condition) from the bearings. These specialized components and geometries nevertheless provide collapsible energy absorbing interfaces under lower G-force stresses.

As further shown in FIG. 1, the stator 32 is substantially elongated in shape and defines a central axis 40 along which the nose member 24 and the projectile body 26 preferably extend. Additionally, the stator 32 and the rotor 34 form a motor/generator 42 which is constructed and arranged to control rotation of the rotor 34 relative to the stator 32 around the central axis 40 based on electrical signals from the control circuitry 38 (e.g., via alternating current through the stator 32). The motor/generator 42 further generates power to reduce battery requirements of the nose member articulation assembly 22 (e.g., to reduce the number and/or size of power cells mounted to a fixed location on the stator 32).

The nose member articulation assembly 22 further includes a nose member actuator 50 having a base 52, an arm 54 and a motor 56 (shown generally by the arrow 56 in FIG. 1). The base 52 of the nose member actuator 50 mounts to a fixed location on the stator 32. The arm 54 of the nose member actuator 50 pivotally mounts to the nose member 24. The motor 56 of the nose member actuator 50 controls movement of the arm 54 relative to the base 52. In some arrangements, the nose member actuator 50 is formed by a drive screw actuator and a crank arm. It should be understood that the position the arm 54 and the base 52 relative to each other controls the angular displacement (X) of the nose member 24 relative to the projectile body 26. If alignment with the central axis 40 is considered zero degrees, the range of potential displacement (A) is preferably up to 12 degrees. Other ranges of displacement are suitable as well such as +/−10 degrees, and so on.

During operation, a launch system (e.g., a cannon) is capable of firing the guidable projectile 20 in the positive Z-direction. In this situation, the entire guidable projectile 20 spins or rifles in a particular rotational direction around the Z-axis (e.g., clockwise when viewed facing the nose member 24 of the guidable projectile 20). The control circuitry 38 is then capable of operating the motor/generator 42 in the opposite direction to that of the guidable projectile 20 (e.g., in the counterclockwise direction when viewed facing the nose member 24 of the guidable projectile 20) to slow (i.e., "de-spin") and eventually stop the stator 32 and the nose member 24 from rotation relative to the earth. In particular, an inertial guidance system is capable of providing input to the control circuitry 38 to direct the motor 42 to provide a proper amount of rotation in the opposite direction so that the stator 32 and the nose member 24 are no longer substantially rotating relative to points on the ground.

Once the motor/generator 42 has de-spun the stator 32 and the nose member 24 relative to the ground, the stator 32 and the nose member 24 are essentially in a geostatic orientation in terms of rotation. In this situation, the inertial guidance system is capable of directing the control circuitry 38 to modify the angular displacement (or tilt) of the nose member 24 and is thus capable of controlling the trajectory of the guidable projectile 20 while the guidable projectile 20 is in flight.

For example, suppose that the guidable projectile 20 is in substantially horizontal flight and that the stator 32 is in the orientation shown in FIG. 1. That is, the Z-axis points in the direction of flight and the Y-axis points away from the ground. Here, a linear displacement of the arm 54 in the negative Z-direction results in tilting of the nose member 24 in a downward direction thus steering the guidable projectile 20 in the negative Y-direction toward the ground. Similarly, linear displacement of the arm 54 in the positive Z-direction results in pointing of the nose member 24 in an upward direction thus possibly providing a lifting vector to the guidable projectile 20 in the positive Y-direction which enables the guidable projectile 20 to extend its ground distance. Other directional changes are available as well by changing the rotational speed of the generator/motor 42 to orient the stator 32 at a different angle relative to the ground and then operating the nose member actuator 50 (i.e., azimuth control).

It should be understood that the above-described guidable projectile 20 is suitable for a variety of applications including guided rockets, guided missiles, guided torpedoes, and similar guidable objects. In some arrangements, the nose member 24 defines a space 60 which is capable of supporting a payload (e.g., an inertial guidance system, sensors, other electronics, an explosive charge, etc.). Similarly, in some arrangements, the projectile body 26 defines a space 62 which is capable of supporting another payload (e.g., a propulsion system, an explosive charge, etc.).

It should be further understood that containment of the motor stator 32, control circuitry 38 and other control electronics (e.g., batteries, an inertial guidance system in the space 60 defined by the nose member 24, etc.) is capable of occurring exclusively on the stator 32 and/or the nose member 24. Accordingly, there is no need to convey electrical signals from the rotor 34 or the projectile body 26. As a result, no slip rings are required to power or control the motor/generator 42. Further details will now be provided with reference to FIG. 1.

Figure 2:
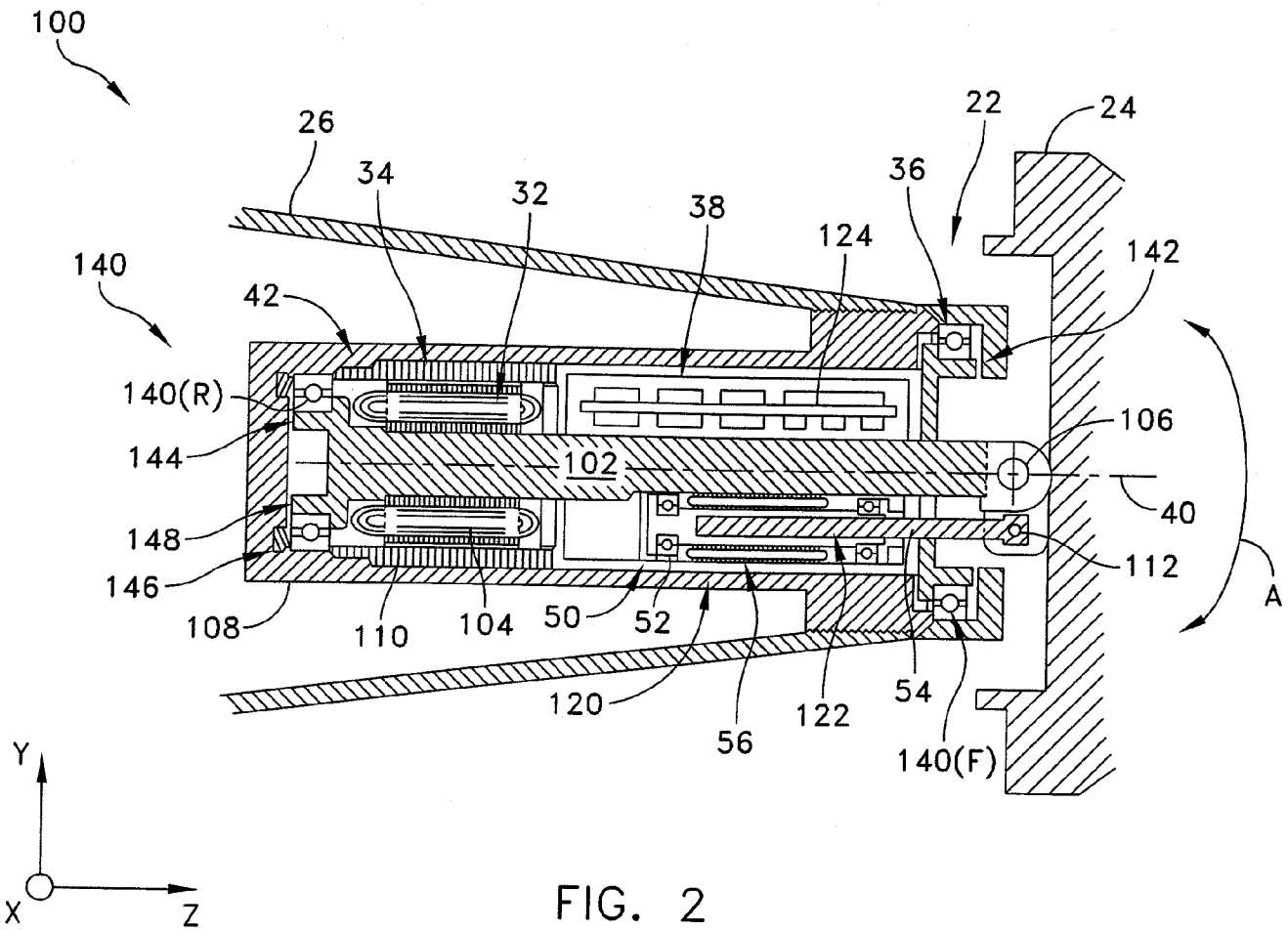
FIG. 2 is a detailed cross-sectional view of the guidable projectile of FIG. 1.

FIG. 2 is a cross-sectional view of a portion 100 of an embodiment of the guidable projectile 20. As shown, the stator 32 of the motor/generator 42 includes a stator shaft (or spindle) 102 and a set of motor windings 104. The stator shaft 102 extends along the central axis 40, and rigidly supports the motor windings 104.

Additionally, the stator shaft 102 is rotationally static with respect to the nose member 24. That is, the stator shaft 102 is capable of rotating relative to the rotor 34 about the central axis 40 in unison with the nose member 24. Furthermore, the nose member 24 is capable of pivoting relative to the stator shaft 102 about a hinge 106 which extends along the X-axis in FIG. 2.

The rotor 34 of the motor/generator 42 includes a rotor housing 108 and a set of magnets 110. The rotor housing 108 rigidly supports the magnets 110. In some arrangements, the material of the rotor housing 108 has soft magnetic properties (material with low magnetic flux resistance such as iron or steel) so that the rotor housing 108 acts as the back iron for the magnets 110 (i.e., to close the flux path between the opposite poles of the magnets). Alternatively, the magnets are supported within the inside diameter of a ring of soft magnetic material which is secured in the rotor housing. Rare earth magnets, ring magnets, Samarium-Cobalt magnets, and so on are capable of being used for the magnets.

It should be understood that there is a motor/generator relationship between the windings 104 of the stator 32 and the magnets 110 of the rotor 34. Along these lines, during operation, the control circuitry 38 of the motor/generator 42 is constructed and arranged to control electric current through the windings 104 of the stator 32 (e.g., commutation) and thus control rotation of the rotor 34 around the stator 32. Such motorized operation enables the stator 32 and the nose member 24 to remain stationary from a rotational standpoint relative to the ground during flight, while the rotor 34 and the projectile body continue to rotate around the central axis 40 (e.g., at several thousands of rotations per minute).

Although power cells have been omitted from FIG. 2 for simplicity, it should be understood that the guidable projectile 20 preferably includes a set of power cells, and that rotation of the motor/generator 42 generates power that decreases the need for a large number of cells and/or for large power cell capacity. That is, due to rotation of the rotor 34 relative to the stator 32 of the motor/generator 42, the windings 104 are capable of providing a charge which recharges or sustains the power cells. Preferably, the power cells reside on the stator shaft 102 at a fixed location for convenient electrical connection to the control circuitry 38.

As further shown in FIG. 2, the base 52 of the nose member actuator 50 mounts to a fixed location on the stator shaft 102 and is thus rotationally static with respect to the stator shaft 102 and the nose member 24. The arm 54 of the nose member actuator 50 is pivotally attached to an offset location on the nose member 24. In particular, the arm 54 is capable of tilting the nose member 24 about a hinge 112, which extends along the X-axis in FIG. 2 and which is offset (e.g., off center) from the stator shaft hinge 106. Accordingly, the arm 54 is well-positioned to tilt the nose member 24 around the stator shaft hinge 106 to an angular displacement (A) relative to the stator 32.

It should be understood that the nose member actuator 50 is capable of being implemented as a drive screw actuator 120 and a crank arm 122. In this situation, the nose member 24 preferably can rotate up to 12 degrees from the central axis 40 in any direction due to operation of the drive screw actuator 120 (for tilting about the hinge 106) and further due to operation of the motor/generator 42 (for orientation of the stator shaft 102 around the central axis 40).

In some arrangements, the control circuitry 38 includes a two-channel drive circuit 124 having a first channel to drive the motor/generator 42, and a second channel to drive the nose member actuator 50. In these arrangements, the control circuitry 38 preferably receives signals from position sensors (e.g., Hall effect sensors or magnetic encoders) for feedback control. Since the control circuitry 38 resides at a fixed mounting location on the stator shaft 102 and electrically connects to both the motor/generator 42 and the nose member actuator 50 which are also at fixed mounting locations on the stator shaft 102, there is no need for any slip rings to convey electrical signals there between.

As further shown in FIG. 2, the rotational support hardware 36 of the nose member articulation assembly 22 includes a set of front bearings 140(F) and a set of rear bearings 140(R) (collectively, bearings 140). The front bearings 140(F) are disposed adjacent a front end 142 of the stator shaft 102. The rear bearings 140(R) are disposed adjacent a rear end 144 of the stator shaft 102. The bearings 140 are arranged to facilitate rotation of the rotor housing 108 relative to the stator shaft 102 around the central axis 40.

The rotation support hardware 36 further includes a set of energy absorbing interfaces 146 (e.g., Belleville springs, tolerance rings, etc.) which provide dampening and cushioning between the stator shaft 102 and the rotor housing 108. As will be discussed in further detail shortly, the stator shaft 102 defines a set of unloading surfaces 148. These unloading surfaces 148 are arranged to make contact with the rotor housing 108 to prevent overloading of the bearings 140 and the energy absorbing springs 146 when the guidable projectile 20 undergoes extreme acceleration (e.g., acceleration above a predefined threshold) in various directions such as in the positive Z-direction when the guidable projectile 20 is launched from a cannon. Further details will now be provided with reference to FIG. 3.

Figure 3:
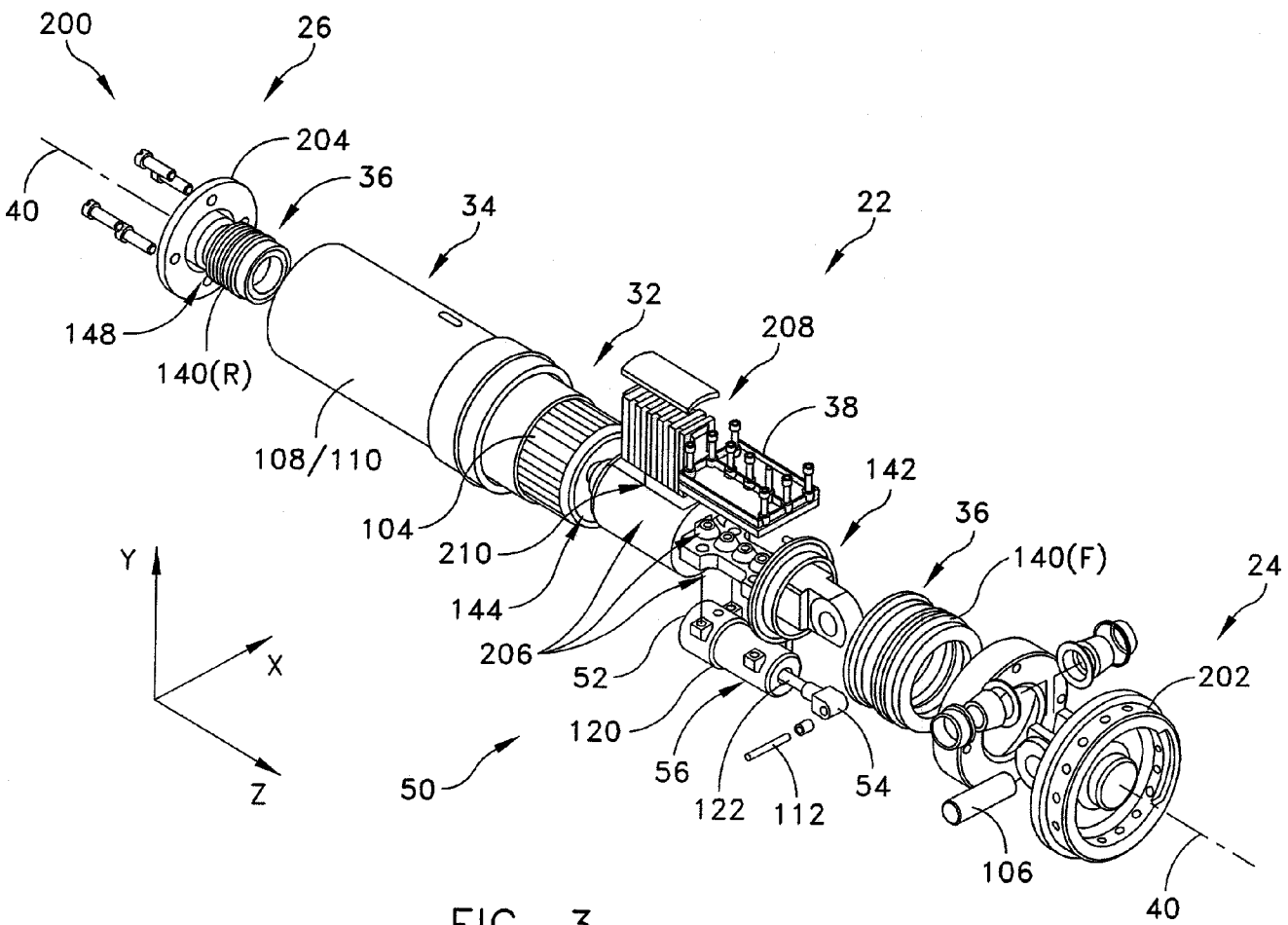
FIG. 3 is an exploded perspective view of the guidable projectile of FIG. 1.

FIG. 3 is a detailed exploded perspective view of a portion 200 of an embodiment of the guidable projectile 20. As shown, the stator shaft 102 is constructed and arranged to pivotally link with a portion 202 of the nose member 24. Furthermore, the rotor housing 108 is constructed and arranged to rigidly fasten to a portion 204 of the projectile body 26.

As further shown in FIG. 3, the stator shaft 102 defines multiple mounting locations 206 on which certain components are capable of rigidly mounting. In particular, the control circuitry 38, the nose member actuator 50, and power cells 208 rigidly mount to the stator shaft 102 at those mounting locations 206. Accordingly, the stator shaft 102 essentially acts as a platform for supporting a variety of operating components.

By way of example only, the power cells 208, which provides power to operate the motor/generator 42 and the nose member actuator 50, is shown as being contained within a hollow but enclosed cavity 210 defined by the stator shaft 102. Since the power cells 208 in combination with the motor/generator 42 are constructed and arranged to provide ample power to control rotation of the motor/generator 42 and operation of the nose member actuator 50 during flight of the guidable projectile 20, there no need for slip rings to convey electrical signals. Further details will now be provided with reference to FIGS. 4 and 5.

Figure 4:
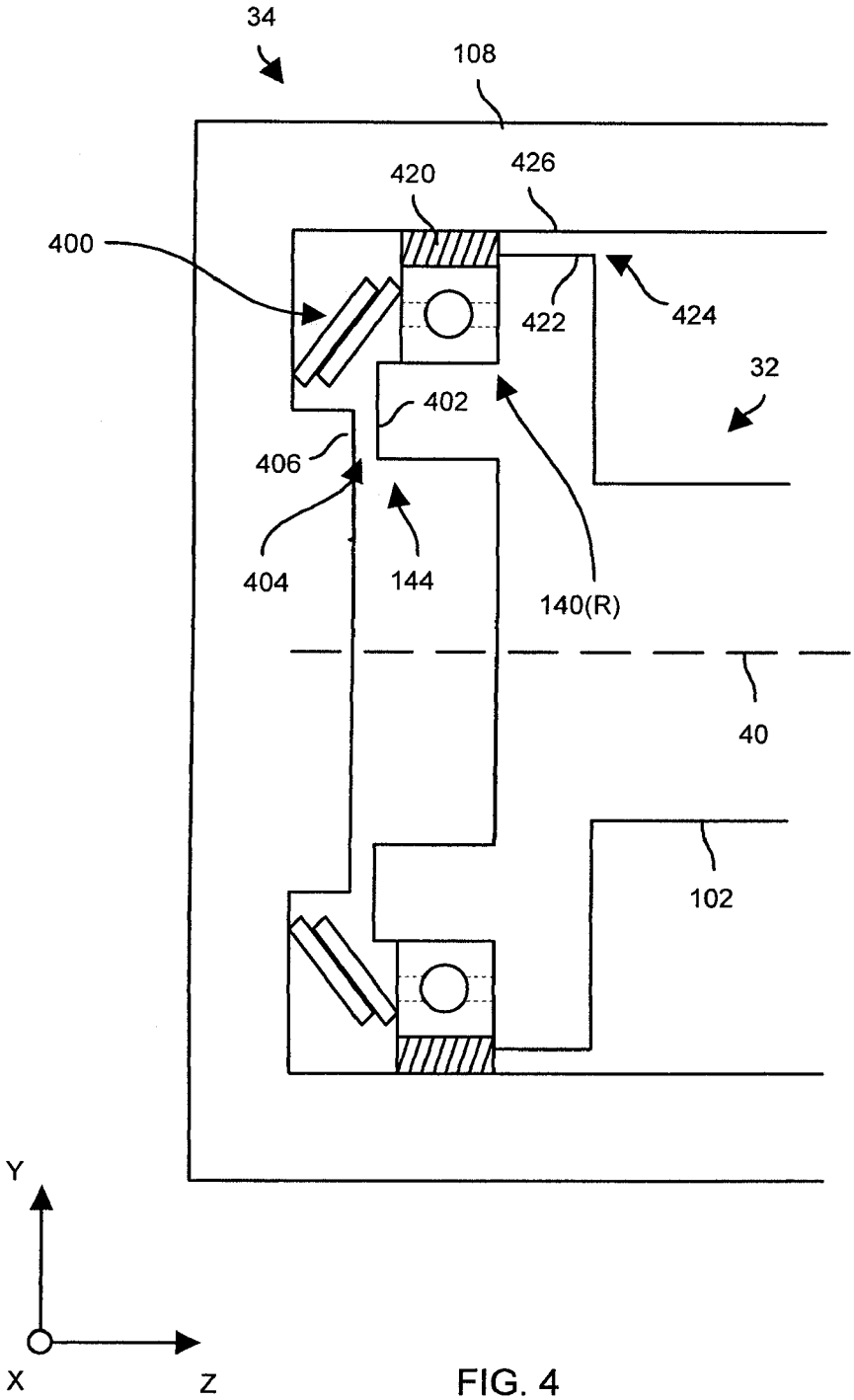
FIG. 4 is a detailed cross-sectional view of a particular portion of the guidable projectile of FIG. 1.
Figure 5:
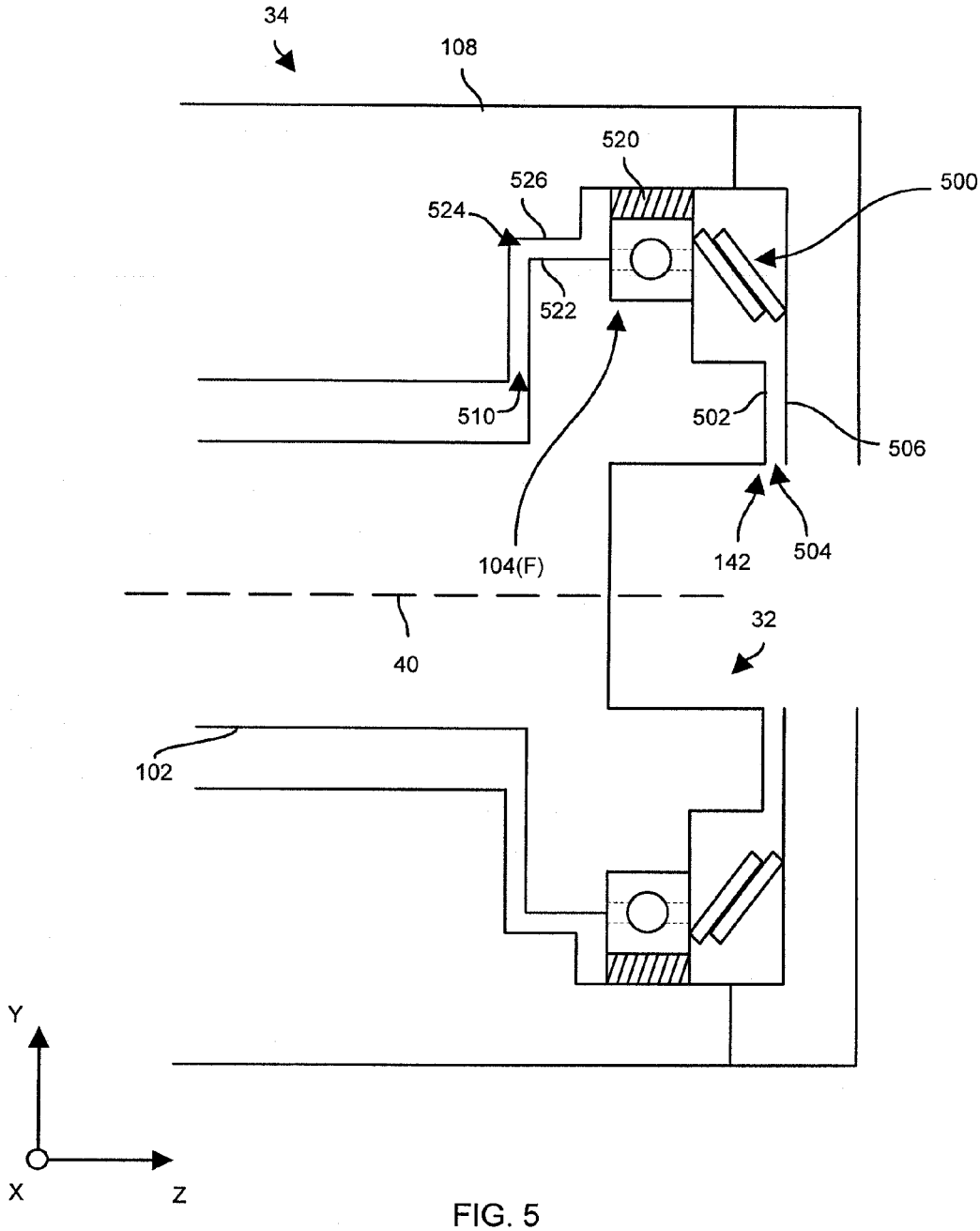
FIG. 5 is a detailed cross-sectional view of another particular portion of the guidable projectile of FIG. 1.

FIGS. 4 and 5 illustrate certain unloading features of the guidable projectile 20. FIG. 4 shows a cross-sectional view of a portion of the guidable projectile 20 at the rear end 144 of the stator shaft 102. FIG. 5 shows a cross-sectional view of a portion of the guidable projectile 20 at the front end 142 of the stator shaft 102. As shown in FIGS. 4 and 5, the rotor housing 108 rotates about the stator shaft 102 (i.e., around the central axis 40) thus enabling the stator shaft 102, the nose member 24 and various mounted components, to remain rotationally static relative to the ground, while the rotor housing 108 rifles during flight of the guidable projectile 20. It should be understood that the windings 104 of the stator 32 and the magnets 110 are purposefully omitted from FIGS. 4 and 5 to better illustrate other features of the guidable projectile 20.

As shown in FIG. 4, the rotational support hardware 36 includes a set of axial displacement loading springs 400 which are disposed between the stator shaft 102 and the rotor housing 108 (also see the energy absorbing interfaces 146 in FIG. 2). The axial displacement loading springs 400 apply a force onto the rear bearings 140(R) and the stator shaft 102 in the positive Z-direction. In some arrangements, the axial displacement loading springs 400 are Belleville springs.

As further shown in FIG. 4, the end 144 of the stator shaft 102 defines an unloading surface 402 (also see the unloading surfaces 148 in FIG. 2). An axial gap 404 exists between the unloading surface 402 and a corresponding surface 406 defined by the rotor housing 108.

Similarly, as shown in FIG. 5, the rotational support hardware 36 includes a set of axial displacement loading springs 500 which are disposed between the stator shaft 102 and the rotor housing 108. The axial displacement loading springs 500 apply a force onto the front bearings 140(F) and the stator shaft 102 in the negative Z-direction. In some arrangements, the axial displacement loading springs 500 are Belleville springs.

As further shown in FIG. 5, the end 142 of the stator shaft 102 defines an unloading surface 502. An axial gap 504 exists between the unloading surface 502 and a corresponding surface 506 defined by the rotor housing 108.

It should be understood that balancing between the axial displacement loading springs 400, 500 maintains both the axial gap 404 (FIG. 4) and the axial gap 504 (FIG. 5) during conditions of no or low acceleration. That is, the axial displacement loading springs 400, 500 effectively suspend the stator shaft 102 (or at least a portion of the stator shaft 102) within the rotor housing 108 as long as the guidable projectile undergoes acceleration which is less than a predetermined threshold (prior to launch, after launch, etc.). During this time, the axial loading springs 400, 500 operate as collapsible energy absorbing interfaces 146 (FIG. 2) between the stator shaft 102 and the rotor housing 108.

In contrast, when the guidable projectile 20 undergoes extreme high G-force acceleration in the positive Z-direction, the unloading surface 402 defined by the stator shaft 102 contacts the corresponding surface 406 defined by the rotor housing 108. Such a situation may exist during launching of the guidable projectile 20 from a cannon. During such a situation, the axial displacement loading springs 400 deform to allow direct contact between the stator shaft 102 and the rotor housing 108. As a result, the bearings 104(R) are protected against overloading and damage.

It should be understood that additional axial gaps, which are similar to the axial gap 404, may be distributed between the stator shaft 102 and the rotor housing 108. Such distributed placement of these additional axial gaps spreads out the contact surface area between the stator shaft 102 and the rotor housing 108 to reduce stresses at any particular point. By way of example, FIG. 5 shows another axial gap 510 which operates to protect the bearing rolling elements and contact raceways.

It should be further understood that, when the guidable projectile 20 undergoes extreme high G-force acceleration in the negative Z-direction, the unloading surface 502 defined by the stator shaft 102 contacts the corresponding surface 506 defined by the rotor housing 108. Here, the axial displacement loading springs 500 again deform to allow direct contact between the stator shaft 102 and the rotor housing 108. Accordingly, the bearings 104(F) are protected against overloading and damage.

Additionally, and as shown in FIG. 4, the rotational support hardware 36 further includes a set of radial displacement loading springs 420 which are disposed between the stator shaft 102 and the rotor housing 108. The radial displacement loading springs 420 apply a radial force onto the stator shaft 102 from the rotor housing 108 toward the central axis 40. In some arrangements, the set of axial displacement loading springs 420 is a set of tolerance rings (or corrugated rings).

As further shown in FIG. 4, a suitable position for the set of radial displacement loading springs 420 is between the rear bearings 140(R) and the rotor housing 108. An alternative position for the set of radial displacement loading springs 420 is between the rear bearings 140(R) and the stator shaft 102.

As further shown in FIG. 4, the end 144 of the stator shaft 102 further defines an unloading surface 422. A radial gap 424 exists between the unloading surface 422 and a corresponding surface 426 defined by the rotor housing 108.

Similarly, and as shown in FIG. 5, the rotational support hardware 36 further includes a set of radial displacement loading springs 520 which are disposed between the stator shaft 102 and the rotor housing 108. The radial displacement loading springs 520 apply a radial force onto the stator shaft 102 from the rotor housing 108 toward the central axis 40. In some arrangements, the set of axial displacement loading springs 520 is a set of tolerance rings (or corrugated rings).

As further shown in FIG. 5, a suitable position for the set of radial displacement loading springs 520 is between the front bearings 140(F) and the rotor housing 108. An alternative position for the set of radial displacement loading springs 520 is between the front bearings 140(F) and the stator shaft 102.

As further shown in FIG. 5, the end 142 of the stator shaft 102 further defines an unloading surface 522. A radial gap 524 exists between the unloading surface 522 and a corresponding surface 526 defined by the rotor housing 108.

It should be understood that the radial displacement loading springs 420, 520 maintain the radial gap 424 (FIG. 4) and the radial gap 524 (FIG. 5) during situations of no or little radial displacement. That is, during this time, the radial displacement loading springs 420, 520 operate as collapsible energy absorbing interfaces 146 between the stator shaft 102 and the rotor housing 108.

In contrast, during situations of substantial radial acceleration which causes significant radial displacement, one or more of the unloading surfaces 422, 522 defined by the stator shaft 102 contact the corresponding one or more surfaces 426, 526 defined by the rotor housing 108. That is, the radial displacement loading springs 420, 520 deform to allow direct contact between the stator shaft 102 and the rotor housing 108. As a result, the bearings 104(R), 104(F) are protected against damage. Such operation prevents overloading of the bearings 104(R), 104(F) when radial acceleration exceeds a predetermined threshold.

Based on the above, it should be understood that an example set of predefined thresholds is that set of thresholds which enables the various load bearing elements (e.g., the bearings 140) to survive the extreme loading encountered during a cannon launch of a guided missile. Such an extreme loading condition may last only for a split second but provide many thousands of pounds of force. For example, in the context of 20,000 to 30,000 G's on a four pound component, there could otherwise be 80,000 pounds of force on the load bearing elements without protection. To prevent such force from destroying the load bearing elements, the collapsible energy absorbing interfaces of the rotational support hardware 36 and the gaps between the unloading surfaces and corresponding surfaces are such that the load bearing elements (i) operate by bearing the load in normal conditions (i.e., G-forces well under 20,000 to 30,000 G's) but (ii) are shielded from damage during the extreme loading conditions.

As described above, improved nose articulation techniques involve utilization of (i) a stator 32 which attaches to a nose member 24 (e.g., a nose cone of a guidable projectile) and (ii) a rotor 34 which attaches to a projectile body 26 (e.g., a main casing of the guidable projectile). Accordingly, the stator 32 and the rotor 34 form a motor/generator 42 which is capable of (i) controlling rotation of the projectile body 26 relative to the nose member 24 as well as (ii) generating electrical power. Moreover, electrical control of the stator 32 and other electrical or electromechanical components (e.g., a nose cone actuator) are capable of residing at fixed locations 206 relative to the stator 32 (e.g., on the stator shaft 102) thus alleviating any need to convey electrical power and electrical control signals from the projectile body 26 to the stator 32 or to the nose member 24 through slip rings.

It should be understood that the above-described nose articulation techniques are well suited for a variety of applications such as one that involves maneuvering a body using a motor rotational in one direction to move an aerodynamic device in an oscillating motion. A similar application is described in U.S. application Ser. No. 11/651,864, entitled "ECCENTRIC DRIVE CONTROL ACTUATION SYSTEM", the teachings of which are hereby incorporated by reference in their entirety.

One will appreciate that the nose member articulation assembly 22 was described above as being well-suited for guided missile applications. It should be understood that the nose member articulation assembly 22 is a mechanism that enables conversion of an existing "dumb" artillery round or a legacy dumb round design into a "smart" round. In particular, one is capable of making a dumb round smart by attaching the nose member articulation assembly 22 to the front of the dumb round. Alternatively, one is capable of making a smart round by interconnecting the nose member articulation assembly 22 between (i) the nose, or fuse, of the dumb round and (ii) the following body which carries the explosive charge or other payload of the dumb round.

Additionally, it should be understood that the axial displacement loading springs were described above as Belleville springs by way of example only. Other loading springs are suitable for use as well such as finger springs, wave spring washers, curved springs, tab washers, notch washers, and the like.

Similarly, it should be understood that the radial displacement loading springs were described above as tolerance rings by way of example only. Other loading springs are suitable for use as well such as washers, leaf springs, circular suspensions, and the like.

Furthermore, one will appreciate that the stator shaft 102 is a convenient centralized foundation for mounting devices. Along these lines, recall that the motor/generator 42 is arranged to rotate in a reverse direction to that of the projectile body 26 to de-spin the nose member 24. That is, due to the reverse rotation, the stator shaft 102 remains substantially stable with minimal rotation relative to the ground during projectile flight. In this situation, the stator shaft 102 provides a unique mounting platform for supporting a variety of operable components. In particular, the stator shaft 102 is well-suited for supporting additional surface control mechanisms that improve the ability of the guidable projectile 20 to reach an intended target. Various surface control arrangements will now be provided with reference to FIGS. 6 through 10.

Figure 6:
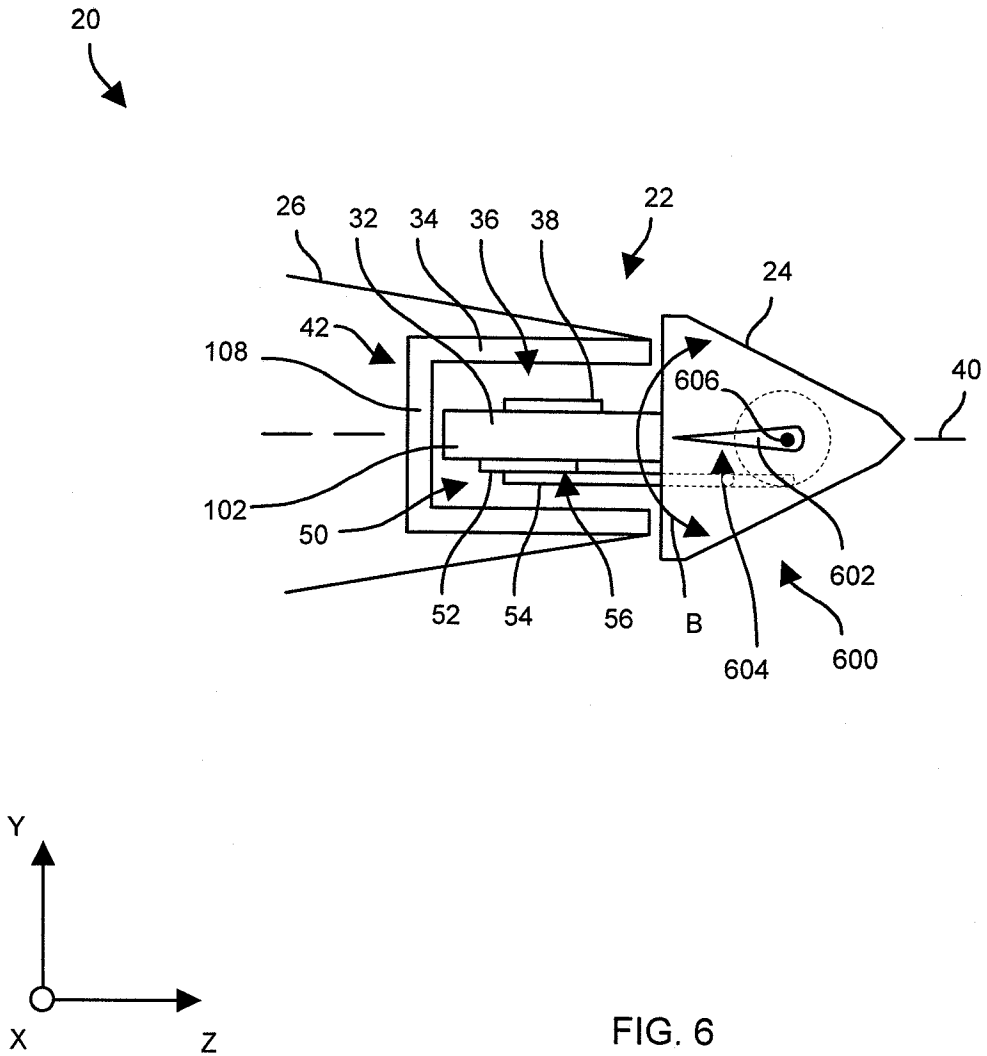
FIG. 6 is a general view of the guidable projectile with a movable member which defines a surface controlled by an actuator which is supported by a de-spun central shaft.

FIG. 6 is a view of a portion of the guidable projectile 20 where the tilting feature of the nose member 24 (FIG. 1) is replaced with a static nose member 24 and a surface control assembly 600. The surface control assembly 600 is formed by a movable member 602 and the earlier-mentioned electromagnetic actuator 50. In this situation, the electromagnetic actuator 50 is arranged to control movement of the movable member 602 relative to the central stator shaft 102 and thus provide trajectory control.

It should be understood that only one surface control assembly 600 is shown in FIG. 6 for simplicity. Nevertheless, the guidable projectile 20 is capable of including multiple surface control assemblies 600 (e.g., symmetrical about the central axis) for greater trajectory control. Suitable patterns include symmetrical fin/flap patterns (e.g., two fins, three fins, four fins, etc.).

During operation, the nose member 24 rotates in unison with the stator shaft 102 relative to the rotor housing 108 and the projectile body 26 for stabilization of the guidable projectile 20. The nose member 24 de-spins relative to the ground, but does not angularly displace relative to the central axis 40 as described earlier in connection with FIG. 1. Rather, the stator shaft 102 now supports the movable member 602 which defines a flight control surface 604 (e.g., a movable fin, a flap or other similar flight control member defining a control surface). In particular, the movable member 602 is capable of pivoting about a hinge 606 (extending in the X-direction of FIG. 6) in response to operation of the actuator 50. Through angular movement of the movable member 602, the direction of the control surface 604 and thus the direction of the guidable projectile 20 can be changed. Additionally, an extreme displacement of the movable member 602, or the combined displacements of multiple movable members 602, are capable of providing braking to the guidable projectile 20. As a result, the guidable projectile 20 enjoys robust flight control via the angular displacement (B) of the movable member 602.

It should be understood that each surface control assembly 600 is capable of further including additional parts which provide further features. For example, in some arrangements, the surface control assembly 600 includes a latching mechanism that biases the control surface 604 toward a specific operational position. Such a latching mechanism provides the ability to hold the control surface 604 at a particular angular orientation without providing constant electric current to the actuator 50 to maintain the control surface 604 at that particular angular orientation thus conserving power.

Figure 7:
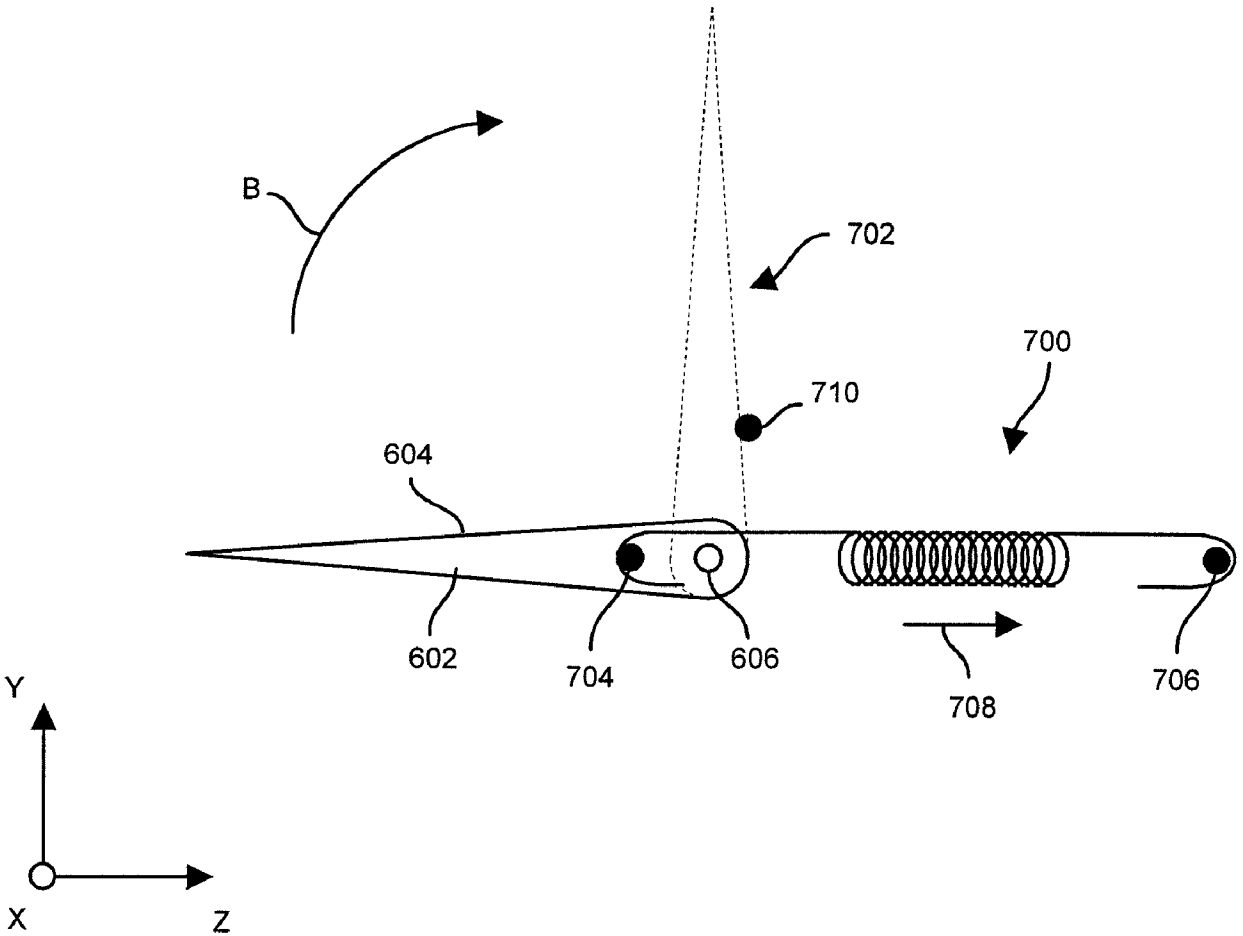
FIG. 7 is a general view of a latching mechanism which is arranged to bias the movable member of FIG. 6 to a latching position.

FIG. 7 is a general view of a latching mechanism 700 which is arranged to bias the movable member 602 of FIG. 6 toward a latching position 702 (shown in phantom). The latching mechanism 700 is illustrated as a pull spring (e.g., a coil spring) having one end at a movable attachment point 704 on the movable member 602 and another end at a fixed attachment point 706 (e.g., on the stator shaft 102 or on the nose member 24, also see FIG. 6). This pull spring provides an attractive spring force 708 which biases the movable member 602 in the clockwise direction about the hinge 606. Such an arrangement may be suitable for a situation in which it is desirable for the control surface 604 to provide braking for the guidable projectile 20.

Angular displacement (B) of the movable member 602 provided by the operation of the actuator 50 (FIG. 6) and the latching mechanism 700 is illustrated by the arrow in FIG. 7. Although drag may prevent the movable member 602 from ultimately reaching the latching position 702 during flight, a stop 710 (e.g., on the stator shaft 102 or on the nose member 24, also see FIG. 6) prevents over travel of the movable member past the latching position 702.

Figure 8:
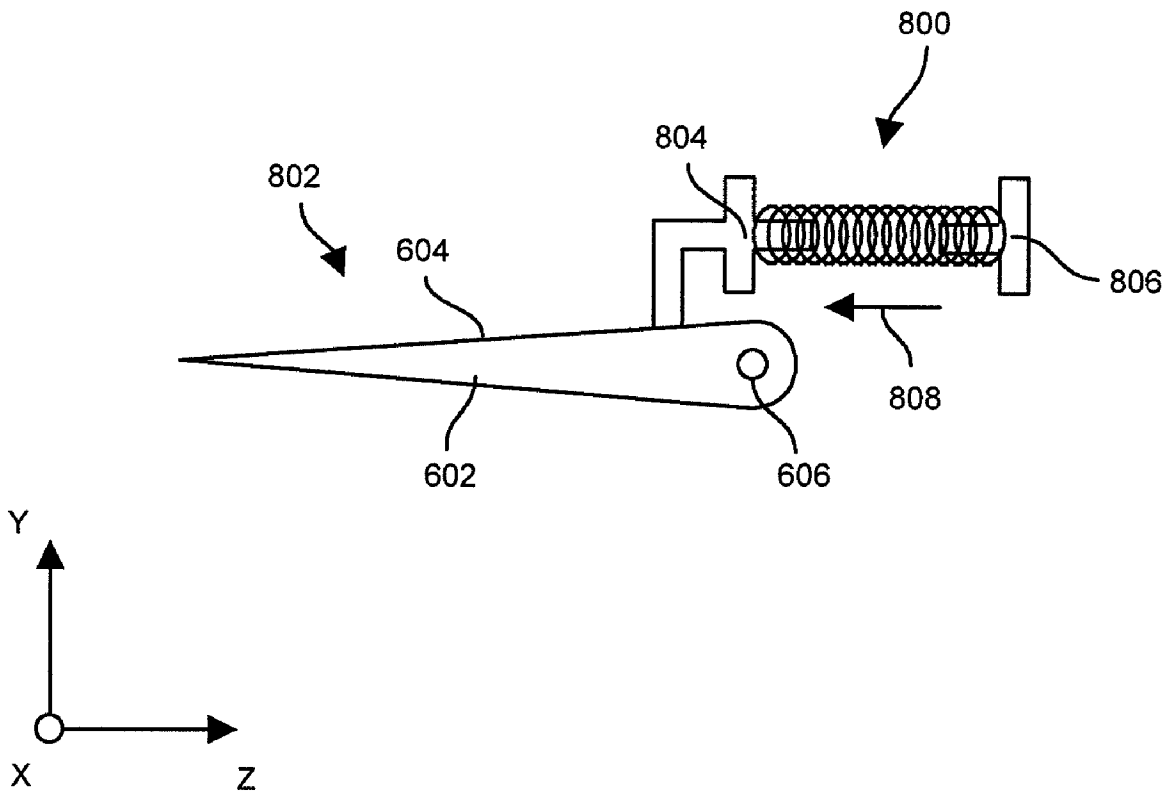
FIG. 8 is a general view of another latching mechanism which is arranged to bias the movable member of FIG. 6 to a latching position.

FIG. 8 is a general view of a latching mechanism 800 which is arranged to bias the movable member 602 of FIG. 6 toward its initial position 802. For example, if an external force attempts to deflect the movable member 602 in the clockwise direction from the Z-axis, the latching mechanism provides counter force to urge the movable member 602 back to its original orientation along the Z-axis.

The latching mechanism 800 is illustrated as a push spring (e.g., a coil spring) having one end at a movable attachment point 804 on the movable member 602 and another end at a fixed attachment point 806 (e.g., on the stator shaft 102 or on the nose member 24, also see FIG. 6). This push spring provides a repulsive spring force 808 which biases the movable member 602 in the counterclockwise direction about the hinge 606.

It should be understood that multiple latching mechanisms can be provided to a single movable member 602 to bias that movable member 602 in two directions, i.e., in the clockwise direction and the counterclockwise direction. In such a situation, the multiple latching mechanisms work to maintain the movable member 602 at a precise latching location.

It should be further understood that the multiple latching mechanisms may provide attractive forces in opposite directions to achieve proper biasing (e.g., a balance between attractive forces). Alternatively, the multiple latching mechanisms may provide a combination of an attractive force and a repulsive force in opposite directions to achieve proper biasing (e.g., the latching mechanisms 700, 800 simultaneously imposed on the guidable projectile 20 as shown in FIG. 6). Moreover, other latch-style configurations are suitable for use by the guidable projectile 20.

Figure 9:
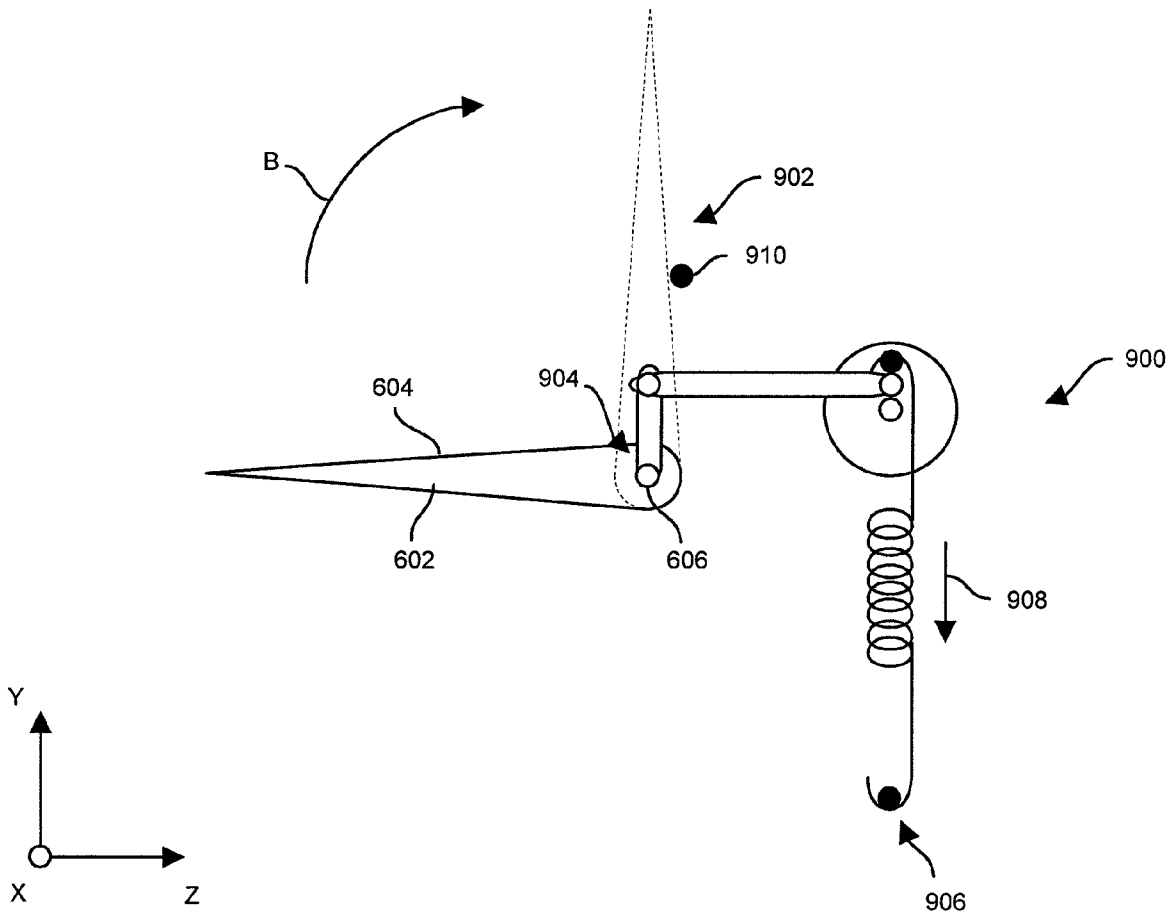
FIG. 9 is a general view of an eccentric latching mechanism which is arranged to bias the movable member of FIG. 6 to a latching position.

FIG. 9 is a general view of an eccentric latching mechanism 900 which is arranged to bias the movable member 602 of FIG. 6 toward a latching position 902 (shown in phantom). The latching mechanism 900 is illustrated as linkage and a pull spring (e.g., a coil spring) having one end at a movable attachment point 904 on the movable member 602 and another end at a fixed attachment point 906 (e.g., on the stator shaft 102 or on the nose member 24, also see FIG. 6). This pull spring provides an attractive spring force 908 which biases the movable member 602 in the clockwise direction about the hinge 606. Such an arrangement may be suitable for a situation in which it is desirable for the control surface 604 to provide braking for the guidable projectile 20. Other linkage configurations are suitable for use as well.

Angular displacement (B) of the movable member 602 provided by the operation of the actuator 50 (FIG. 6) and the latching mechanism 900 is illustrated by the arrow in FIG. 9. Although drag may prevent the movable member 602 from ultimately reaching the latching position 902 during flight, a stop 910 prevents over travel of the movable member past the latching position 702.

As described above, there are a variety of latching means which are suitable for biasing the movable member 602 to one or more latching positions. It should be understood that the latching means and the electromagnetic actuator which positions the movable member 602 are capable of being integrated together into a hybrid design. It should be further understood that the latching means, regardless of whether it is discrete or integrated with the electromagnetic actuator, is capable of providing biasing to multiple latching positions.

Figure 10:
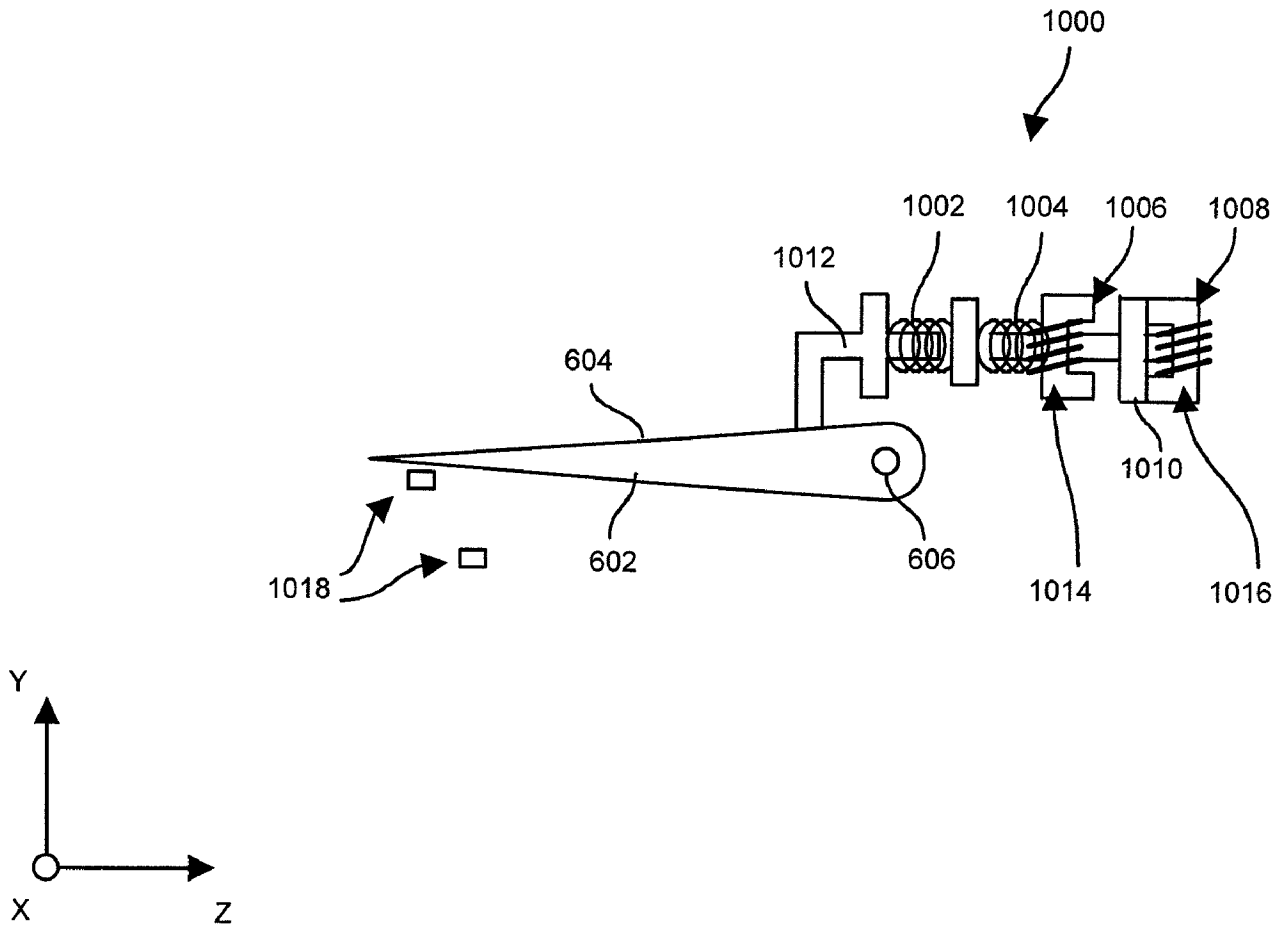
FIG. 10 is a general view of an electromagnetic actuator which is arranged to control the movable member of FIG. 6.

FIG. 10 is a general view of an integrated actuator/latching mechanism 1000 which is arranged to control the position of the movable member 602. The integrated actuator/latching mechanism 1000 provides biasing between multiple latching positions.

As shown in FIG. 10, the integrated actuator/latching mechanism 1000 includes springs 1002, 1004, electromagnets 1006, 1008, and a magnetic plate 1010 containing a permanent magnet. The spring 1002 provides attractive force in the negative Z-direction while the spring 1004 provide repulsive force in the positive Z-direction. The electromagnets 1006, 1008 are under control of the control circuitry 38 (FIG. 1) and control the movement of the magnetic plate 1010. The magnetic plate 1010 is located between the electromagnets 1006, 1008 and mechanically links to the movable member 602 via mechanical linkage 1012.

During operation, when a current is flowing in the coil 1014 of the electromagnet 1006, the electromagnet 1006 is activated and generates a magnetic field which attracts the magnetic plate 1010. Accordingly, the magnetic plate 1010 moves in the negative Z-direction and comes into contact with the electromagnet 1006. As a result, the movable member 602 moves in the counterclockwise direction about the hinge 606.

Alternatively, when a current is flowing in the coil 1016 of the electromagnet 1008, the electromagnet 1008 is activated and generates a magnetic field which attracts the magnetic plate 1010. This situation is shown in FIG. 10. Accordingly, the magnetic plate 1010 moves in the positive Z-direction and comes into contact with the electromagnet 1008. As a result, the movable member 602 angularly displaces in the clockwise direction about the hinge 606.

In some arrangements, the integrated actuator/latching mechanism 1000 operates with the involvement of position sensors 1018 (e.g., Hall sensors) which provide feedback to the control circuitry 38 for closed loop control. The position sensors 1018 can be located adjacent the movable member 602 to directly measure the position of the movable member 602 (see FIG. 10). As an alternative, the position sensors 1018 can be located adjacent the integrated actuator/latching mechanism 1000 to indirectly measure the position of the movable member 602 by sensing the position of a component of the integrated actuator/latching mechanism 1000 (e.g., the location of the magnetic plate 1010). As yet another alternative, the position sensors 1018 can reside at both locations for redundancy.

While various embodiments of the invention have been particularly shown and described, it will be understood by those skilled in the art that various changes in form and details may be made therein without departing from the spirit and scope of the invention as defined by the appended claims.

For example, it should be understood that the latching mechanisms 700, 800, 900, 1000 were described above as providing attractive or repulsive forces to the movable member 602 by way of example only. In other arrangements in which the nose member 24 is capable of tilting, such latching mechanisms provide biasing to the nose member 24. The control of other craft surfaces is possible as well such as flaps, rudders, ailerons, propellers, spoilers, and the like. Such operation enables control of flight control surfaces with less current thus conserving power consumed during flight.

What is claimed is:

1. A surface control assembly, comprising:

a central shaft mount arranged to mount to a central shaft of a guidable projectile, the guidable projectile having a roll portion which rotates around at least a portion of the central shaft during flight of the guidable projectile to provide stabilization;

a movable member arranged to control a trajectory of the guidable projectile during flight of the guidable projectile, wherein the movable member defines a flight control surface;

an electromagnetic actuator interconnected between the central shaft mount and the movable member, the electromagnetic actuator being arranged to control movement of the movable member relative to the central shaft mount, wherein the electromagnetic actuator is arranged to control angular orientation of the flight control surface relative to a central axis defined by the central shaft; and a latching mechanism supported by the central shaft mount, the latching mechanism being arranged to bias the movable member to a latching position relative to the central shaft mount.

2. A surface control assembly as in claim 1 wherein the latching mechanism includes:

a pull spring having a first end adjacent the central shaft mount and a second end adjacent the movable member, the pull spring being arranged to provide an attractive spring force which biases the movable member to the latching position relative to the central shaft mount.

3. A surface control assembly as in claim 1 wherein the latching mechanism includes:

a push spring having a first end adjacent the central shaft mount and a second end adjacent the movable member, the push spring being arranged to provide a repulsive spring force which biases the movable member to the latching position relative to the central shaft mount.

4. A surface control assembly as in claim 1 wherein the latching mechanism includes:

a pull spring having a first end adjacent the central shaft mount and a second end adjacent the movable member, the pull spring being arranged to provide an attractive spring force which biases the movable member in a first direction relative to the central shaft mount; and a push spring having a first end adjacent the central shaft mount and a second end adjacent the movable member, the push spring being arranged to provide a repulsive spring force which biases the movable member in a second direction relative to the central shaft mount, the attractive spring force provided by the pull spring and the repulsive spring force provided by the push spring operating to substantially bias the movable member to the latching position relative to the central shaft mount.

5. A surface control assembly as in claim 1 wherein the movable member is a nose cone of the guidable projectile;

wherein the roll portion is a projectile body of the guidable projectile which follows the nose cone during flight; and wherein the electromagnetic actuator is arranged to tilt the nose cone relative to the projectile body during flight.

6. A surface control assembly as in claim 1, further comprising:

a static nose member which is constructed and arranged to couple to the central shaft and remain substantially stationary with respect to the central shaft during flight, the movable member being constructed and arranged to move relative to the static nose member during flight to provide trajectory control.

7. A surface control assembly as in claim 6, further comprising:

a hinge having a first end coupled to the central shaft mount and residing within the static nose member, a second end coupled to the movable member, and mid section which extends between the first and second ends and through an opening defined by the static nose member.

8. A guidable projectile having a surface control assembly as in claim 1.

9. A surface control assembly, comprising:

a central shaft mount arranged to mount to a central shaft of a guidable projectile, the guidable projectile having a roll portion which rotates around at least a portion of the central shaft during flight of the guidable projectile to provide stabilization;

a movable member arranged to control a trajectory of the guidable projectile during flight of the guidable projectile, wherein the movable member defines a flight control surface; and an electromagnetic actuator interconnected between the central shaft mount and the movable member, the electromagnetic actuator being arranged to control movement of the movable member relative to the central shaft mount, wherein the electromagnetic actuator is arranged to control angular orientation of the flight control surface relative to a central axis defined by the central shaft;

wherein the electromagnetic actuator includes (i) a first coil disposed at a first location relative to the central shaft mount, (ii) a second coil disposed at a second location relative to the central shaft mount, and (iii) a permanent magnet disposed between the first and second coils;

wherein the first coil and the second coil are arranged to receive respective electrical signals from control circuitry disposed at a fixed location relative to the central shaft mount; and wherein the angular orientation of the flight control surface defined by the movable member is dependent on an amount of displacement of the permanent magnet between the first and second coils.

10. A surface control assembly as in claim 9 wherein the movable member is a nose cone of the guidable projectile;

wherein the roll portion is a projectile body of the guidable projectile which follows the nose cone during flight; and wherein the electromagnetic actuator is arranged to tilt the nose cone relative to the projectile body during flight.

11. A surface control assembly as in claim 9, further comprising:

a static nose member which is constructed and arranged to couple to the central shaft and remain substantially stationary with respect to the central shaft during flight, the movable member being constructed and arranged to move relative to the static nose member during flight to provide trajectory control.

12. A surface control assembly as in claim 11, further comprising:

a hinge having a first end coupled to the central shaft mount and residing within the static nose member, a second end coupled to the movable member, and mid section which extends between the first and second ends and through an opening defined by the static nose member.

13. A guidable projectile having a surface control assembly as in claim 9.

14. A surface control assembly, comprising:

a central shaft mount arranged to mount to a central shaft of a guidable projectile, the guidable projectile having a roll portion which rotates around at least a portion of the central shaft during flight of the guidable projectile to provide stabilization;

a movable member arranged to control a trajectory of the guidable projectile during flight of the guidable projectile, wherein the movable member defines a flight control surface; and an electromagnetic actuator interconnected between the central shaft mount and the movable member, the electromagnetic actuator being arranged to control movement of the movable member relative to the central shaft mount, wherein the electromagnetic actuator is arranged to control angular orientation of the flight control surface relative to a central axis defined by the central shaft; wherein the electromagnetic actuator includes:

a coil and a soft magnetic member having soft magnetic material, the coil and the soft magnetic member forming a soft magnet in response to an electrical signal from control circuitry disposed at a fixed location relative to the central shaft mount, the angular orientation of the flight control surface defined by the movable member being dependent on an amount of displacement of the soft magnetic member relative to the central shaft mount.

15. A surface control assembly as in claim 14 wherein the movable member is a nose cone of the guidable projectile;

wherein the roll portion is a projectile body of the guidable projectile which follows the nose cone during flight; and wherein the electromagnetic actuator is arranged to tilt the nose cone relative to the projectile body during flight.

16. A surface control assembly as in claim 14, further comprising:

a static nose member which is constructed and arranged to couple to the central shaft and remain substantially stationary with respect to the central shaft during flight, the movable member being constructed and arranged to move relative to the static nose member during flight to provide trajectory control.

17. A surface control assembly as in claim 16, further comprising:

a hinge having a first end coupled to the central shaft mount and residing within the static nose member, a second end coupled to the movable member, and mid section which extends between the first and second ends and through an opening defined by the static nose member.

18. A guidable projectile having a surface control assembly as in claim 14.

19. A surface control assembly, comprising:

a central shaft mount arranged to mount to a central shaft of a guidable projectile, the guidable projectile having a roll portion which rotates around at least a portion of the central shaft during flight of the guidable projectile to provide stabilization;

a movable member arranged to control a trajectory of the guidable projectile during flight of the guidable projectile; and an electromagnetic actuator interconnected between the central shaft mount and the movable member, the electromagnetic actuator being arranged to control movement of the movable member relative to the central shaft mount;

wherein the movable member is a fin of the guidable projectile;

wherein the roll portion is a projectile body of the guidable projectile which follows the nose cone during flight; and wherein the electromagnetic actuator is arranged to control angular displacement of the fin relative to the projectile body during flight.

20. A guidable projectile having a surface control assembly as in claim 19.

* * * * *